United States Patent [19]

Carr et al.

[11] Patent Number: 5,030,152

[45] Date of Patent: Jul. 9, 1991

[54] LIFE SAVING DEVICE

[76] Inventors: Richard L. Carr, 82 Forest Highlands, Flagstaff, Ariz. 85006; Jack R. Dennison, 2465 W. 12th St., Ste. 6, Tempe, Ariz. 85281

[21] Appl. No.: 475,263

[22] Filed: Feb. 5, 1990

[51] Int. Cl.[5] ..... B63C 9/08

[52] U.S. Cl. ..... 441/89; 441/100; 340/604

[58] Field of Search ..... 441/80, 88, 89, 95, 441/98, 100, 7-9, 11-13, 16; 340/604

[56] References Cited

U.S. PATENT DOCUMENTS

| | | | |
|---|---|---|---|
| 650,976 | 6/1900 | Lavery | 441/100 |
| 923,801 | 6/1909 | Bargar | 441/98 |
| 1,208,232 | 12/1912 | Taylor | 441/98 |
| 1,458,822 | 1/1922 | Halter | 441/98 |
| 3,004,269 | 1/1958 | Dillier | 441/98 |
| 3,810,146 | 5/1974 | Lieb | 441/89 |
| 4,040,135 | 8/1977 | Arnold | 441/11 |
| 4,079,364 | 3/1978 | Antenore | 441/89 |
| 4,276,669 | 7/1981 | Suba | 441/89 |
| 4,714,914 | 12/1987 | Boe | 441/89 |
| 4,813,025 | 3/1989 | Rowland et al. | 441/89 |
| 4,932,910 | 6/1990 | Hayday | 441/9 |

*Primary Examiner*—Jesus D. Sotelo
*Attorney, Agent, or Firm*—Warren F. B. Lindsley

[57] ABSTRACT

A life-saving device for protection against drowning, the device incorporating buoyancy apparatus for holding the potential drowning victim and an attached transmitter above water. A receiver and alarm device converts the signal from the transmitter into audio and visual alarms which summon help.

11 Claims, 2 Drawing Sheets

LIFE SAVING DEVICE

BACKGROUND OF THE INVENTION

With the proliferation of swimming pools in residential areas, drownings are becoming alarmingly prevalent. More often than not, the victims are small children who escape the attention of parents or other caretakers just long enough to wander into the pool area. Before the parent realizes that the child is missing the tragedy has occurred.

There is an urgent need for a protective device that will summon aid before the child or other potential victim has drowned. Such a device should ideally provide buoyancy and at least temporary protection against drowning until help arrives.

DESCRIPTION OF THE PRIOR ART

Various devices for protection against drowning are described in the prior art.

U.S. Pat. No. 650,976 discloses a life preserver which may be pinned to an article of clothing. When the wearer falls into the water, a seal is dissolved and water is allowed into a bag where it mixes with chemicals, forming a gas which inflates the bag.

U.S. Pat. No. 1,208,232 provides another water safety device which may be pinned to an article of clothing. When necessary, the user activated a cord, allowing water to enter and mix with chemicals to inflate the bag.

U.S. Pat. No. 4,276,669 discloses an apparatus secured by means of a belt encircling the wearer's chest and incorporating a whistle. When the device is submerged, the water causes a gas to be released through the whistle to alert passersby.

U.S. Pat. No. 3,810,146 provides a transmitter which may be attached to a child. If the child falls into the water, a switch is activated causing mechanical waves to be transmitted to a sensor that has been installed at an appropriate location in the pool. The sensor activies an alarm.

U.S. Pat. No. 4,714,914 provides a transmitter that is worn for protection against drowning. The transmitter is activated by submersion. The transmitted signal is picked up by a remote receiver which summons aid.

U.S. Pat. Nos. 923,801 and 1,458,822 provide additional versions of buoyancy devices which inflate when submerged in water with U.S. Pat. No. 3,004,269 providing a vest or jacket incorporating pockets that inflate when submerged. U.S. Pat. Nos. 4,079,364 and 4,813,025 describe additional versions of alarm apparatus activated by immersion.

While the prior art devices provide degrees of protection in various forms, a total program of protection is not adequately afforded by any single device. For the highest degree of protection, buoyancy should be provided for both the wearer and the warning device until help arrives. Submersion can disable a whistle or other alarm before help is alerted. Buoyancy alone may not afford adequate protection as the frantically struggling child may still be choked on ingested water. A local alarm such as a whistle worn by the victim is not adequate because it will not likely be heard inside a house, particularly if a radio or television is operating.

The present invention addresses the need for a total program of protection that is not effectively afforded by any single prior art device or apparatus.

SUMMARY OF THE INVENTION

In accordance with the invention claimed, an improved life saving device is provided for protection against drowning, the device comprising an inflatable balloon and a transmitter attached to the clothing of the person for whom protection is to be provided, together with a remote receiver and alarm unit. In the event the wearer of the device falls into the water, submersion of the device causes the balloon to inflate, thereby temporarily holding the wearer face-up at the surface and also holding the transmitter at the surface. The water activated transmitter immediately begins transmitting; the remote receiver picks up the signal and sounds the alarm.

It is, therefore, an object of the present invention to provide a life-saving device that will afford a higher degree of protection against drowning, especially for small children.

Another object of the invention is to provide in such a device a total program of protection including buoyancy for the individual and for the warning device and an automatic alarm system that will reliably summon help.

A further object of the invention is to provide such a life-saving device in two parts, including a first part that is pinned or otherwise attached to the clothing of the person to be protected, and a second part comprising a remotely located alarm unit.

A still further object of the invention is to provide as elements of the first part of the device an automatically inflating balloon for buoyancy, and a transmitter, both elements being water-activated.

A still further object of the invention is to provide said first part of the device in a form which, when properly attached to the wearer's clothing, will insure that if the wearer falls into the water the automatically inflated balloon will hold the wearer face-up at the surface of the water and will at the same time hold the transmitter at the surface where its signals may be transmitted to the remote alarm unit.

A still further object of the invention is to provide in the life-saving device of the invention a higher degree of protection than has been afforded by prior art devices, the improved protection for the person and the transmitter prior to the arrival of help, and a reliable and effective alarm system with a capability for summoning aid from nearby or remote locations.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
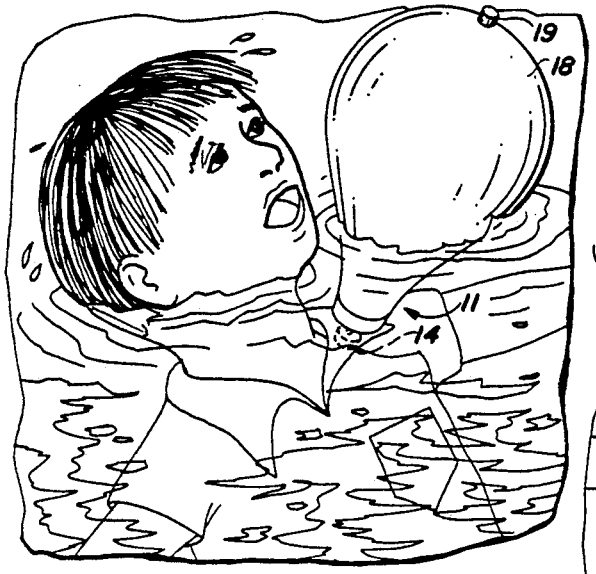
FIG. 1 is a perspective view showing the first part of the life saving device of the invention providing buoyancy to a child who has fallen into the water.
Figure 2A:
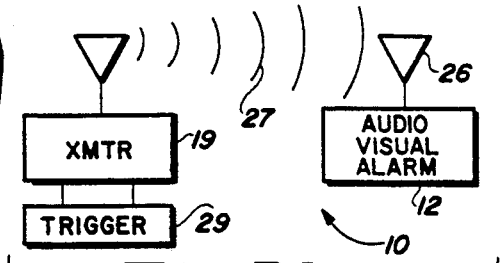
FIG. 2A is a functional block diagram illustrating the operation of the life saving device of the invention.
Figure 2:
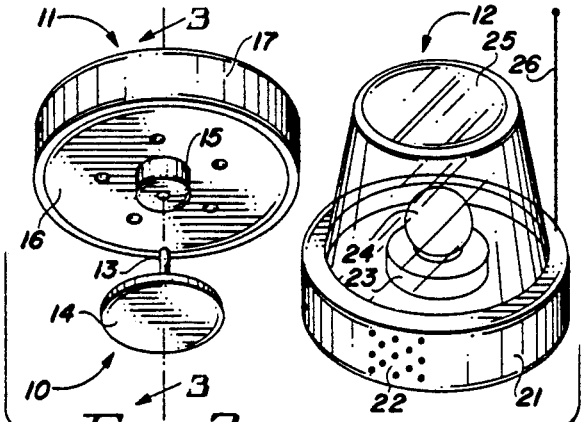
FIG. 2 shows the two parts of the device prior to installation or attachment, the first part being the part of the device intended for attachment to a person's clothing, and the second part comprising the remote alarm unit.

Referring more particularly to the drawing by characters of reference, FIGS. 1–5 disclose the life saving device 10 of the invention. As shown in FIG. 2, the device 10 comprises two main parts. The first part is a buoyancy and transmission device 11; the second part is a receiver and alarm device 12.

Figure 3:
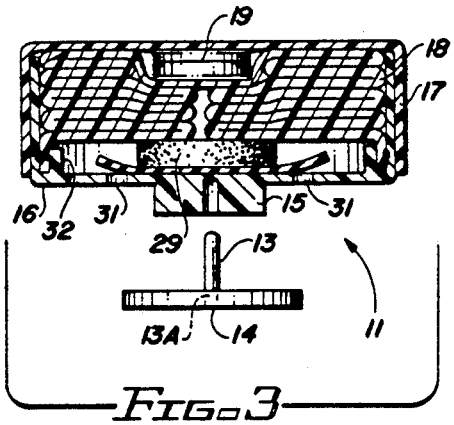
FIG. 3 is a cross-sectional view of the first part of the invention as seen along line 3—3 of FIG. 2.

The buoyancy and transmission device 11 is equipped with means for securely attaching it to an article of clothing and of a type not readily removable by a small child. As illustrated in FIGS. 2 and 3, the attachment means may comprise a gripper 14 having a pin or shaft 13 extending perpendicularly from its bottom, which shaft cooperates with an opening 13A arranged axially in a collar on the bottom of cover 16 into which pin 13 may be inserted. When pin 13 has been inserted it is held firmly by interfering gripping surfaces and cannot be withdrawn or released therefrom unless a release tab 15 at the side of gripper 14 is compressed.

The main part of device 11 is a two-part housing comprising a shallow circular container 16 shaped like a pill box together with a loosely fitting lid or cover 17.

In FIG. 1 device 11 is shown as being attached by means of gripper 14 to the collar of a child who has fallen into the water. As shown, device 11 has been activated by the entry of water into it which has released an envelope or balloon 18 which is automatically inflated to provide buoyancy for the child and for a miniature transmitter 19 including battery energizing means which is attached to the surface of the balloon. This attachment is at a location most likely to extend above the surface of the water. When attached as shown to the collar or frontal neck portion of the child's clothing, balloon 18 insures that the child will be turned face-up in the water and the face of the child will be held above the surface of the water to permit breathing and afford protection against drowning until help arrives.

The receiver and alarm device 12, including battery energizing means, comprises a circular base 21 that encloses a radio receiver and an audible alarm with openings 22 on the side for emission of an audible signal.

Base 21 also carries the socket 23 for a warning light 24 which is protected by a transparent cover 25. An antenna 26 for reception of the transmitter signal extends outwardly of one side of base 21.

The operation of the warning system incorporated in device 10 is illustrated in FIG. 2A. Submersion of device 11 in water causes balloon 18 to inflate. As the balloon begins to inflate its expansion forces the release and separation of cover 17 and the separation of cover 17 from container 16 triggers the operation of transmitter 19. A radio signal 27 from transmitter 19 is received by antenna 26 and is converted to audio and visual alarm signals by the receiver incorporated in alarm device 12.

The cross-sectional view of FIG. 3 shows device 11 prior to activation by the entry of water thereinto. In addition to container 16, cover 17, transmitter 19, pin 13, gripper 14 and balloon 18, as already described, device 11 comprises a flapper valve 28 and a trigger capsule 29.

Flapper valve 28 comprises a circular piece of rubber or similar synthetic material the central portion of which is cemented or otherwise attached to the bottom inside surface of container 16. The outer periphery of valve 28 covers a number of holes 31 in the base of container 16 arranged in a center circle about opening 13A.

Trigger capsule 29 contains a quantity of a chemical that generates a non-toxic gas when dissolved in water. The chemical is preferably formed into a capsule that is held together by a water-solvent binding material. Various types of chemicals that form a non-toxic gas of one kind or another have been described in the prior art. One such material is calcium carbide. The capsule is cemented to valve 28 or is otherwise attached in a central location over the flapper valve 28. Alternatively a quantity of the chemical in crystal or powder form may be contained within the same general area by some appropriate means.

Surrounding valve 28 and trigger capsule 29 is an annular rim 32 which is integral with the base of container 16 and opens upwardly therefrom. The opening of balloon 18 is secured to rim 32 so that the area containing trigger capsule 29 opens into balloon 18 and has no access to the outside atmosphere except via openings 31 which are controlled by valve 28.

In the un-activated condition of device 11, balloon 18 is folded and compressed in accordion fashion to fit compactly for storage within container 16. Transmitter 19, which is secured to the top or crest of balloon 18 rests atop the compressed balloon in a central location just below the cover 17 which holds the balloon and transmitter in place.

Figure 4A:
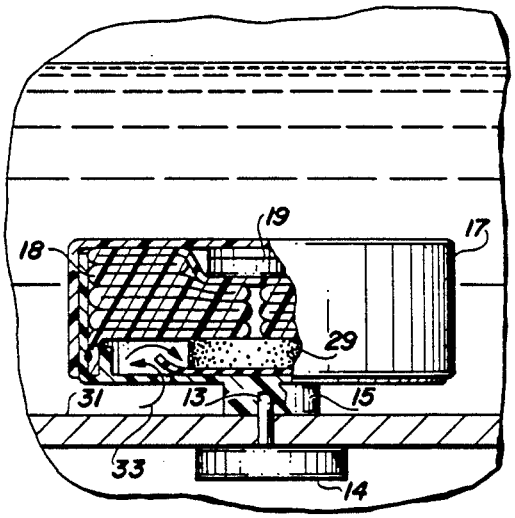
FIGS. 4A–4C are cross sectional views of the first part of the invention shown in successive stages of operation.
Figure 4B:
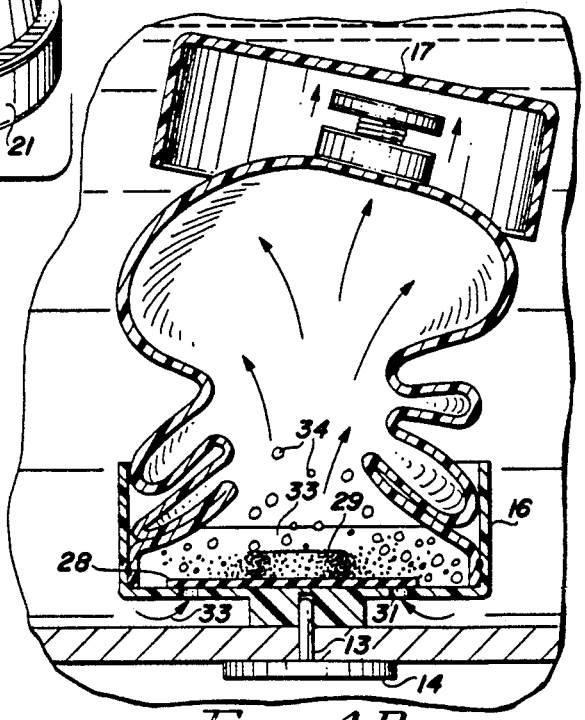
Figure 4C:
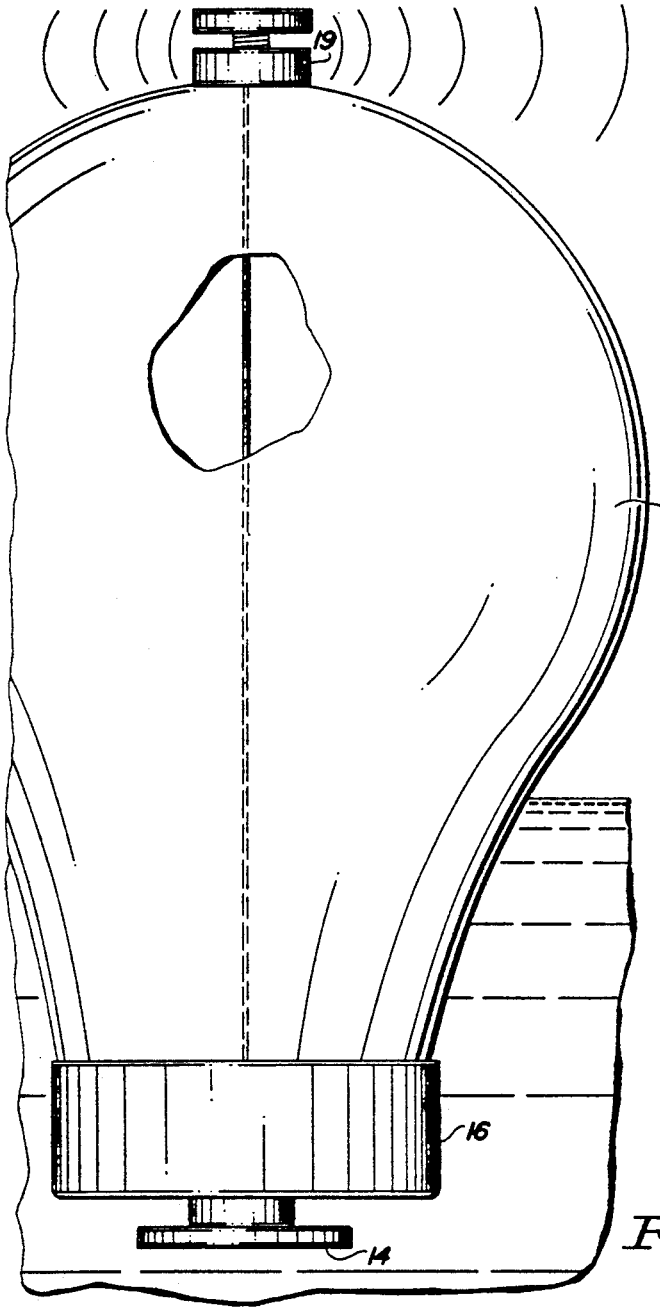

The operation of device 11 when submerged in water is illustrated in successive stages of operation by FIGS. 4A, 4B and 4C.

In the view of FIG. 4A water 33 is just entering device 11 via openings 31. The water enters freely at this time as water pressure forces valve 28 away from openings 31.

When the water comes into contact with the trigger capsule 29, as shown in FIG. 4B, the chemical dissolves and generates gas 34 which quickly fills up the balloon. As the balloon fills with gas it forces cover 17 to detach so that balloon 18 may be fully inflated. At the same time the building pressure within the balloon drives flapper valve 28 against the surface of the base of container 16, covering the openings 31 to close the valve and contain the generated gas within the balloon.

As the balloon expands to its fully inflated condition shown in FIG. 4C, cover 17 falls away exposing transmitter 19 which immediately begins transmitting radio signals to receiver and alarm device 12.

Transmitter 19 incorporates a spring-activated switching mechanism 35 which is employed to activate the transmitter when the inflation of the balloon causes cover 17 to detach from container 16.

Figure 5B:
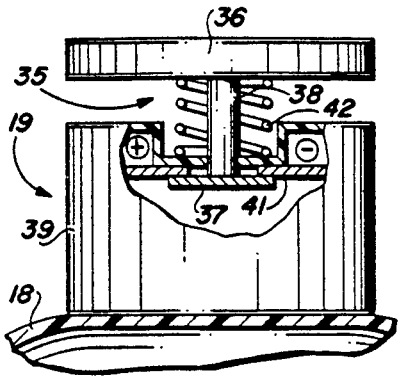
FIGS. 5A–5B are cross-sectional views of the transmitter portion of the first part of the invention shown in successive stages of activation and operation.

As shown most clearly in FIG. 5B, mechanism 35 comprises an actuation button 36 and a contact plate 37 held together as a single unit by a shaft 38. Button 36 is disc-shaped with a diameter matching that of transmitter housing 39. Housing 39 has the form of a short cylinder, and shaft 38 extends axially downward from the button 36 to the center of contact plate 37.

Figure 5A:
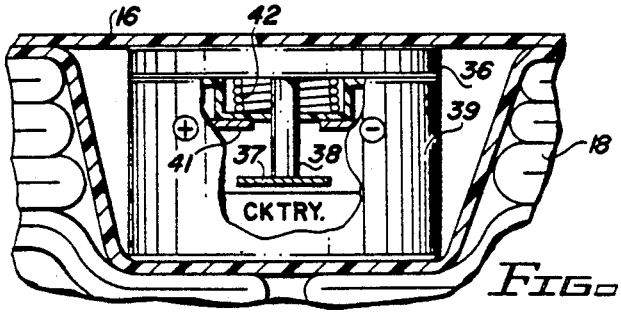

As installed in transmitter 19, shaft 38 passes through an opening in a printed wiring board 41 so that contact plate 37 is positioned below board 41. A compression spring 42 surrounding shaft 38 is held in compression while the transmitter 19 and balloon 18 are confined within container 16 of device 11 as shown in FIG. 5A. Contact plate 37 under these conditions is driven downward against the action of spring 42 by the pressure of cover 17 against button 36. Plate 37 is thus physically separated from printed wiring board 41 so that no electrical contact is made between plate 37 and board 41.

When balloon 18 inflates and cover 17 has been detached, spring 42 drives button 36 and contact plate 37 upward until plate 37 comes to rest against the under surface of printed wiring board 41. Mating electrical contacts located on the under surface of board 41 now make electrical contact with mating conductive surfaces located on the top surface of contact plate 37. The closing of these electrical circuits activates the electrical circuits of transmitter 19 which are mounted on circuit board 20 and in other locations within housing 39. Transmitter 19 immediately begins transmitting signals as illustrated in FIG. 4C.

The life-saving device 10 thus provids a total program of protection. With the receiver and alarm device 12 properly installed in an appropriate location the buoyancy and transmission device 11, which may have the form of a decorative button a child will enjoy wearing, is attached to the clothing of the child as described earlier. If the child manages to fall into the water in spite of all precautions against such an occurrence, device 10 is activated to initiate the program as illustrated in FIG. 2A.

Trigger capsule 29, activated by the entry of water into device 11 generates gas to inflate balloon 18, thereby providing buoyancy for the child, and holding transmitter 19 above the surface of the water. Mechanism 35 immediately activates transmitter 19 which transmits radio signals 27. The radio signals are received by antenna 26 of receiver and alarm device 12. Device 12 converts the radio signals into audible and visual alarms. A loud and immediately recognizable warning signal emanates from openings 22 of device 12 as warning light 24 flashes on and off to emphasize the urgency of coming to the aid of the child. The automatic and immediate response of device 10 to the emergency at hand thus provides a high degree of assurance that the child will still be held above water when help arrives so that a tragic drowning may be prevented.

An improved life-saving device is thus provided for the protection of a child against drowning, the device having been shown to provide a full program of protection in accordance with the stated objects of the invention.

Although but a single embodiment of the invention has been illustrated and described, it will be obvious to those skilled in the art that various changes and modifications may be made therein without departing from the spirit of the invention or from the scope of the appended claims.

What is claimed is:

1. A dual purpose automatically inflatable life preserver and alarm device comprising:

two parts, means for attaching one of said parts to a wearer, said one of said parts comprising a buoyancy and transmission device and the other of said parts comprising a receiver and alarm device.

said one of said parts comprising an inflatable envelope of flexible gas tight material, a transmitter attached to said envelope, and a capsule containing a chemical which generates a non-toxic gas when dissolved in water, said capsule being positioned in said one of said parts to inflate said envelope when said gas is generated, port means in said one of said parts for connecting said capsule to water when said port means is immersed in the water, whereby when said envelope is inflated it triggers said transmitter which activates said receiver and alarm device.

2. The dual purpose automatically inflatable life preserver and alarm device set forth in claim 1 wherein:

said envelope comprises a balloon.

3. The dual purpose automatically inflatable life preserver and alarm device set forth in claim 1 comprising:

flapper means for closing said port means when said envelope is inflated.

4. The dual purpose automatically inflatable life preserver and alarm device set forth in claim 3 wherein:

said gas actuates said flapper means to close said port means upon inflation of said envelope.

5. The dual purpose automatically inflatable life preserver and alarm device set forth in claim 3 wherein:

said flapper means comprises a flexible material which normally closes said port means, opens said port means when first exposed to water pressure and closes said port means against water pressure when exposed to the pressure of said gas.

6. The dual purpose automatically inflatable life preserver and alarm device set forth in claim 5 wherein:

said means for attaching comprises a clasp secured to said one of said parts.

7. The dual purpose automatically inflatable life preserver and alarm device set forth in claim 5 wherein:

said other of said parts comprises a hollow dome shape configuration.

8. The dual purpose automatically inflatable life preserver and alarm device set forth in claim 1 in further combination with:

a collar mounted around said one of said parts for engagement with a container housing said envelope, said envelope when expanded causes said collar to detach from said container and simultaneously triggering said transmitter, said transmitter actuating said receiver and alarm device.

9. The dual purpose automatically inflatable life preserver and alarm device set forth in claim 8 wherein:

said transmitter comprises a printed wiring board and a pair of electrical contacts associated therewith and spring means for holding said contacts apart, said collar when detached from said container releasing said spring means to cause it to close said contacts and energize said transmitter.

10. The dual purpose automatically inflatable life preserver and alarm device set forth in claim 1 wherein:

said receiver and alarm device comprises a warning light.

11. The dual purpose automatically inflatable life preserver and alarm device set forth in claim 1 wherein:

said receiver and alarm device comprises an audio signal.

* * * * *